US005352095A

United States Patent [19]

Tanaka et al.

[11] Patent Number: 5,352,095

[45] Date of Patent: Oct. 4, 1994

[54] METHOD FOR CONTROLLING HYDRAULIC PUMP DRIVEN BY ENGINE

[75] Inventors: Masayuki Tanaka; Isao Murota; Kazuhito Nakai; Makoto Iga, all of Tokyo, Japan

[73] Assignee: Shin Caterpillar Mitsubishi Ltd., Tokyo, Japan

[21] Appl. No.: 997,513

[22] Filed: Dec. 28, 1992

[30] Foreign Application Priority Data

Jun. 10, 1992 [JP] Japan ..... 4-150855

[51] Int. Cl.[5] ..... F04B 49/00

[52] U.S. Cl. ..... 417/12; 417/32

[58] Field of Search ..... 417/12, 18, 22, 32, 417/53; 60/445

[56] References Cited

U.S. PATENT DOCUMENTS

| | | | |
|---|---|---|---|
| 4,763,473 | 8/1988 | Ziplies et al. | 60/431 |
| 4,862,700 | 9/1989 | Suzuki | 417/53 |
| 4,904,161 | 2/1990 | Kamide et al. | 417/22 |
| 5,251,440 | 10/1993 | Bong-dong et al. | 417/32 |

FOREIGN PATENT DOCUMENTS

| | | |
|---|---|---|
| 0277253 | 8/1987 | European Pat. Off. . |
| 3611553 | 7/1987 | Fed. Rep. of Germany . |
| 2669055 | 5/1992 | France . |
| 59-37286 | 6/1984 | Japan . |
| 59-037286 | 6/1984 | Japan . |
| 62-240439 | 10/1987 | Japan . |
| 62-265481 | 11/1987 | Japan . |
| 63-154874 | 4/1988 | Japan . |
| 63154874 | 11/1988 | Japan . |
| 1277630 | 1/1990 | Japan . |
| 3253787 | 2/1992 | Japan . |
| 2251962 | 7/1992 | United Kingdom . |

*Primary Examiner*—Richard A. Bertsch
*Assistant Examiner*—M. Kocharov
*Attorney, Agent, or Firm*—Fish & Richardson

[57] ABSTRACT

A method for controlling a hydraulic pump driven by an engine, including measuring a temperature of at least one of the engine and a hydraulic fluid, comparing the measured temperature with a first predetermined temperature to judge as to whether the measured temperature is higher than the first predetermined temperature or not, comparing the measured temperature with a second predetermined temperature to calculate a difference between the measured temperature and the second predetermined temperature, and decreasing an output flow rate of the hydraulic pump by a degree according to the difference between the measured temperature and the second predetermined temperature, when the measured temperature is judged to be higher than the first predetermined temperature.

20 Claims, 5 Drawing Sheets

$T_{WL2} < T_{WL1}$ $T_{OL2} < T_{OL1}$

| | (ENGINE + HYDRAULIC FLUID) | (ENGINE ALONE) | (HYDRAULIC FLUID ALONE) |
|---|---|---|---|
| QUANTITY OF REDUCTION IN TORQUE (SWASH PLATE) | : $\Delta P_{S1}$ > | $\Delta P_{S2}$ > | $\Delta P_{S3}$ |
| QUANTITY OF REDUCTION IN ENGINE SPEED | : $\Delta N_1$ > | $\Delta N_2$ > | $\Delta N_3$ |
| DELAY TIME | : $CL_1 \leq$ | $CL_2 \leq$ | $CL_3$ |

METHOD FOR CONTROLLING HYDRAULIC PUMP DRIVEN BY ENGINE

BACKGROUND OF THE INVENTION

1. Field of the Invention

The present invention relates to a method of controlling a variable displacement hydraulic pump driven by an engine and a method of controlling a hydraulic pump driving engine.

2. Description of Related Art

Conventional methods and apparatus for preventing a hydraulic pump or an engine for driving the hydraulic pump from overheating are designed to reduce the hydraulic pump or engine load by reducing the engine speed and/or by changing the angle of a swash plate of the swash plate type hydraulic pump and thereby reducing the displacement thereof when the temperature of a cooling water exceeds a predetermined level.

OBJECT AND SUMMARY OF THE INVENTION

An object of the present invention is to provide a method for controlling a hydraulic pump driven by an engine. By this method the hydraulic pump or engine is prevented from overheating and unnecessary decrease of output of the hydraulic pump is prevented.

According to the present invention, a method for controlling a hydraulic pump driven by an engine, comprises the steps of:

- measuring a temperature of one of the engine and a hydraulic fluid,
- comparing the measured temperature with a first predetermined temperature to judge as to whether the measured temperature is higher than the first predetermined temperature or not,
- decreasing an output flow rate of the hydraulic pump from a rated or predetermined value thereof by a degree corresponding to a difference between the measured temperature and a second predetermined temperature, when the measured temperature is judged to be higher than the first predetermined temperature.

Since the output flow rate of the hydraulic pump is decreased from a rated or predetermined flow rate thereof by the degree corresponding to the difference between the measured temperature and the second predetermined temperature when the measured temperature is judged to be higher than the first predetermined temperature, a load of each of the hydraulic pump and the engine is reduced according to an overheat degree of the engine or the hydraulic fluid so that the overheat of the hydraulic pump or engine is prevented and the unnecessary decrease of output of the hydraulic pump is prevented.

DETAILED DESCRIPTION OF THE PREFERRED EMBODIMENTS

Figure 1:
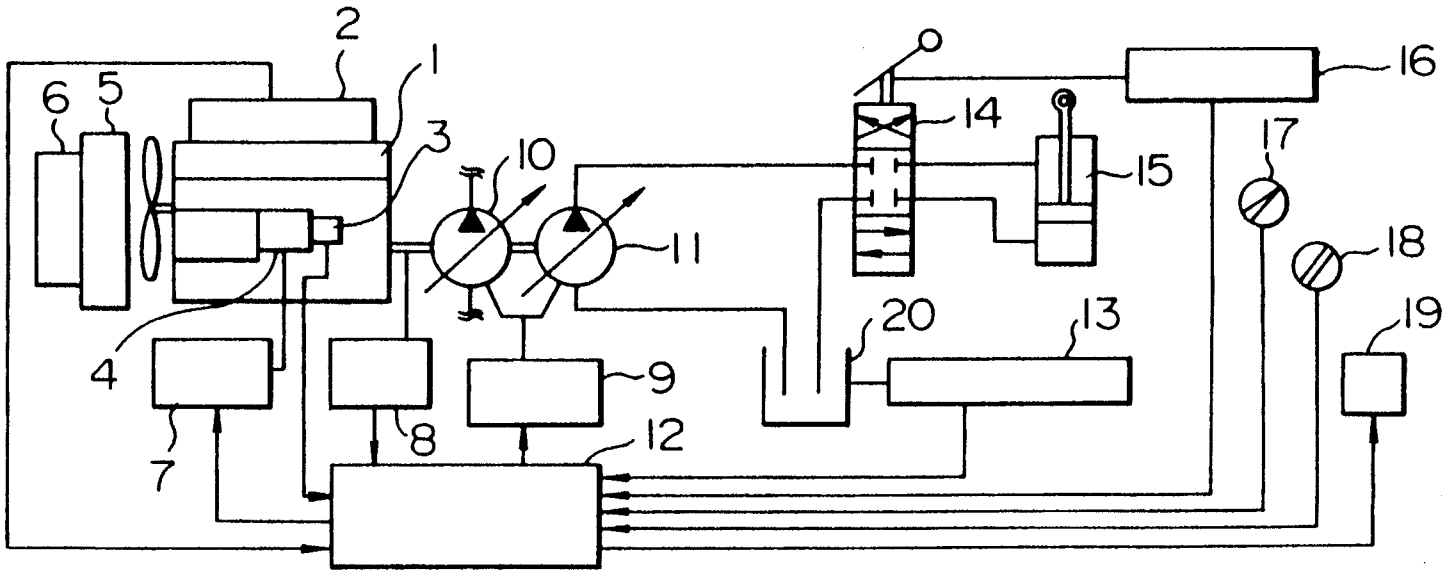
FIG. 1 is a schematic view showing the structure of a hydraulic machine to which the present invention is applied.

FIG. 1 schematically shows the structure of a hydraulic machine to which the present invention is applied. An engine 1, whose output is controlled by a governor 4, drives swash plate type variable displacement hydraulic pumps 10 and 11 which output pressurized hydraulic oil. The governor 4 is controlled in accordance with the position of a governor lever (not shown). The position of the governor lever is changed by means of a governor lever actuator 7 in accordance with the instruction from a controller 12. The position of the governor lever is measured by means of a governor lever position sensor 3, and the measured position is fed back to the controller 12. An engine temperature sensor 2 measures the temperature of the engine by measuring the temperature of the inside of an engine body or of the surface thereof. Engine temperature sensor 2 measures the temperature of either the cooling water which has cooled the engine body or the cooling water which is going to cool the engine body, but preferably measures the cooling water which has just cooled the engine body. Engine temperature sensor 2 can measure the temperature of the engine by measuring the temperature of a pipe through which the cooling water passes or by measuring the temperature of any other appropriate site.

Oil cooler 6 for cooling a hydraulic oil and a radiator 5 for cooling the cooling water are disposed in front of the engine. Engine output speed sensor 8 measures the rotational speed of an output shaft of the engine 1 and sends the measured data to the controller 12. The position of the swash plate of each of the swash plate type variable displacement hydraulic pumps 10 and 11 is changed by means of a swash plate actuator 9 in accordance with the instruction from the controller 12.

Hydraulic oil temperature sensor 13 mounted on a hydraulic oil tank 20 measures the temperature of the hydraulic oil and sends the measured data to the controller 12. The operation of a hydraulic actuator 15 is controlled by controlling the hydraulic pressure supplied from the swash plate type variable displacement hydraulic pumps 10 and 11 by means of an operation valve 14. The instruction of the operator as given to the operation valve 14 is detected by an operation lever sensor 16. Particularly, the operation lever sensor 16 detects the operation instruction that the operator gives to the operation valve 14 to stop operation of the hydraulic actuator 15. A predetermined engine output speed, which is used when no load is applied to the engine, is instructed by means of an accelerator dial 17. The power mode in which the output of the engine 1 is reduced is instructed by means of a power mode switch 18. Monitor 19 displays an alarm to the operator when the engine or hydraulic oil temperature is at or above a predetermined value.

Figure 2:
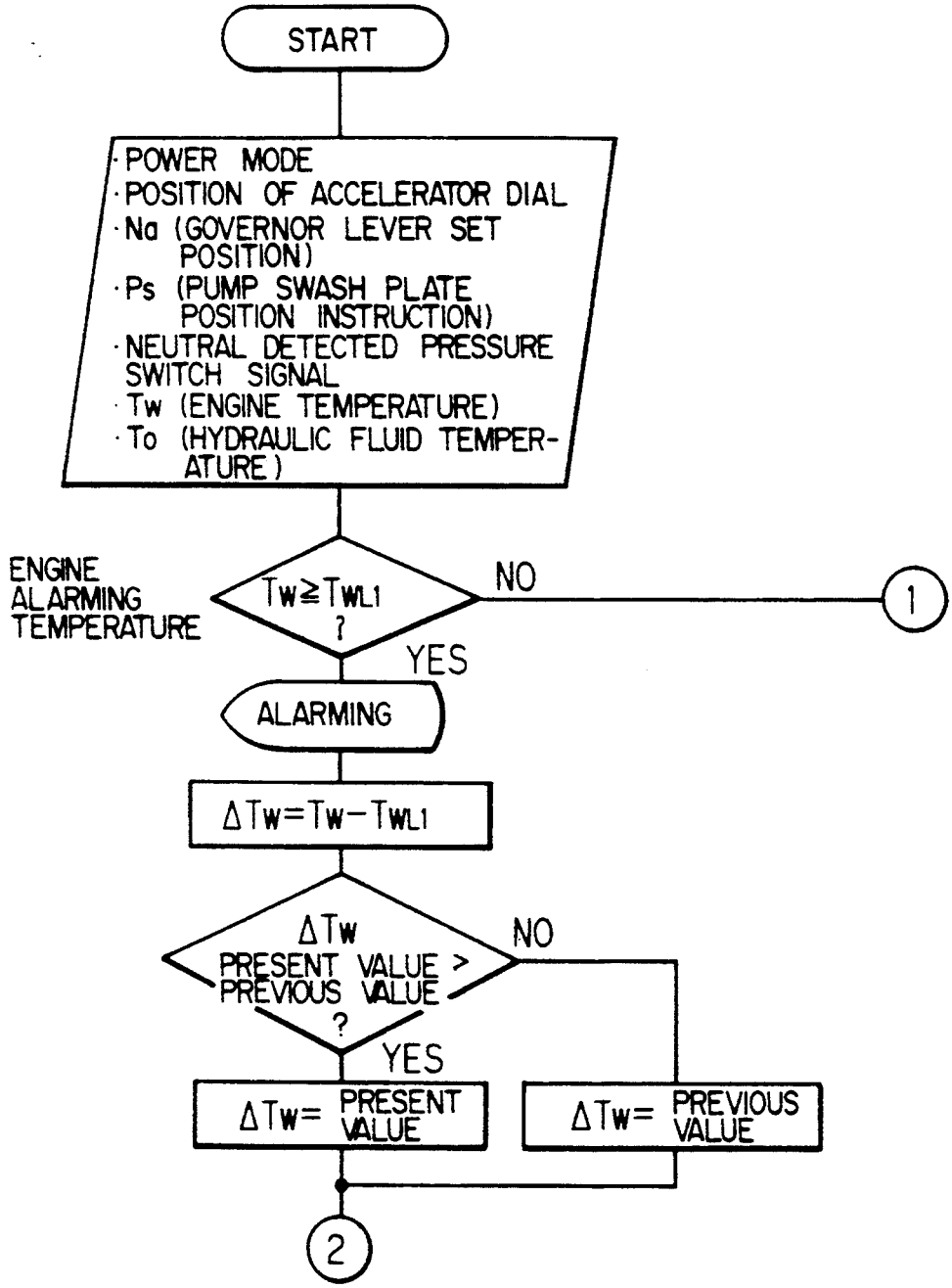
FIG. 2 shows part of the flowchart of the control method according to the present invention.
Figure 3:
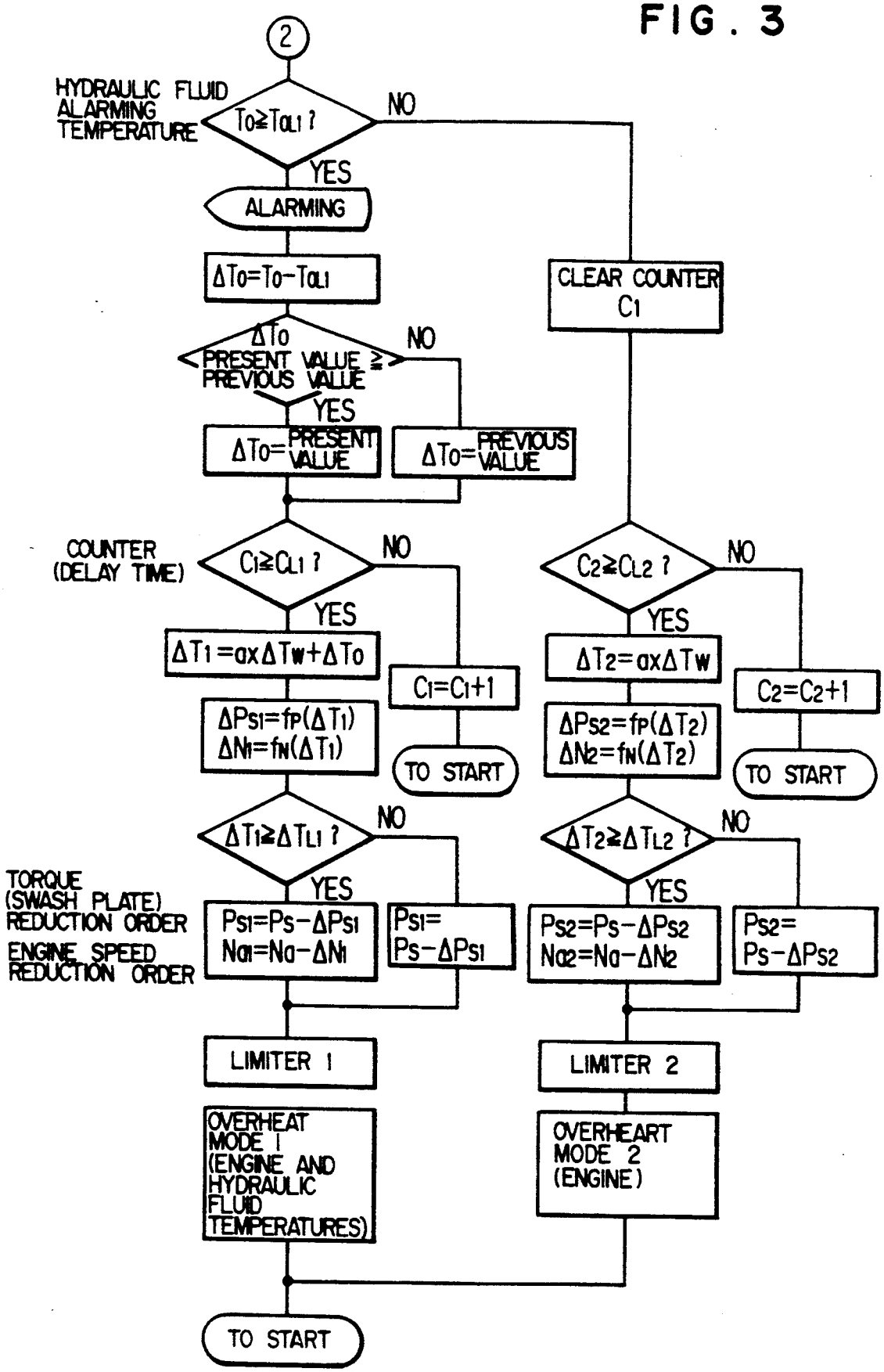
FIG. 3 shows part of the flowchart of the control method according to the present invention.
Figure 4:
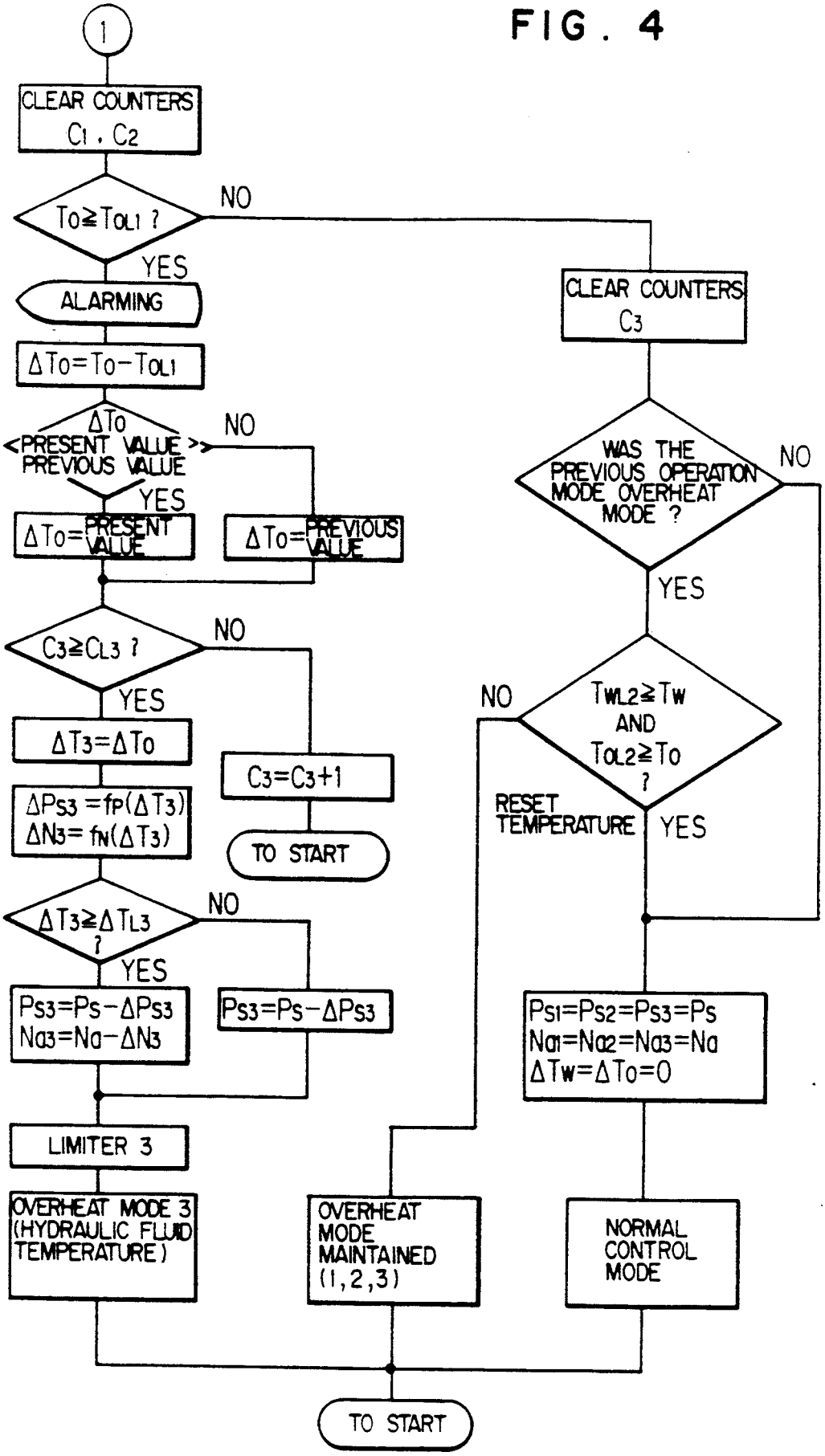
FIG. 4 shows part of the flowchart of the control method according to the present invention.

FIGS. 2 through 4 are flowcharts of the control method according to the present invention. When the control operation according to the present invention is initiated, the controller 12 reads the power mode in which the output of the engine is reduced, the position of the accelerator dial 17 (which instructs a predetermined engine output speed which is used when no load is applied to the engine), a signal which instructs a predetermined set position Na of the governor lever (as determined in accordance with the position of accelerator dial 17), a signal (which instructs a predetermined position PS of the swash plate of each of the swash plate type variable displacement hydraulic pumps 10 and 11), an instruction (that the operator gives to operation valve 14 to stop the operation of the hydraulic actuator 15), an engine temperature TW (measured by the engine temperature sensor 2), and a hydraulic oil temperature TO (measured by the hydraulic oil temperature sensor 13).

If the engine temperature TW is at or above a first predetermined temperature TWL1, it is determined that the engine temperature is in an overheat alarming state, and a difference ΔTW (present value between the engine temperature TW and the first predetermined temperature TWL1 is calculated. It should be noted that the first predetermined temperature used to calculated ΔTW may be another temperature, equal to or less than the first predetermined temperature initially compared with Tw. For simplicity, this description of the present invention refers to both values with the same letters: Twl1 and Tol1. The present value ΔTW is stored in a ΔTW memory, and is compared with ΔTW (previous value) which has been previously calculated and stored in the ΔTW memory. If it is determined that the previous value ΔTW is less than or equal to the present value, the previous value ΔTW is replaced by the present value ΔTW, and the present value ΔTW is stored in the ΔTW memory. If it is determined that the previous value ΔTW is greater than the present value ΔTW, the previous value ΔTW is not replaced by the present value ΔTW and thus the previous value of ΔTW remains in the ΔTW memory without change.

Referring now to FIG. 3, if it is determined that the engine temperature TW is equal to or greater than the first predetermined temperature TWL1 and then it is determined that the hydraulic oil temperature TO is equal to or greater than a first predetermined temperature TOL1, it is determined that the hydraulic oil temperature is in an overheat alarming state. A difference ΔTO between the hydraulic oil temperature TO and the first predetermined temperature TOL1 is then calculated, and the calculated ΔTO (present value) is stored in a ΔTO memory. Present value is compared in the ΔTO memory with ΔTO (previous value) which has been previously calculated and stored in the ΔTO memory. If it is determined that the previous value ΔTO is less than or equal to the present value ΔTO, the previous value ΔTO is replaced by the present value ΔTO, and the present value ΔTO is stored in the ΔTO memory. If it is determined that the previous value ΔTO is equal to the present value ΔTO, the previous value ΔTO is not replaced by the present value ΔTO in the memory and thus the previous value ΔTO remains in the ΔTO memory without change.

If it is determined that the engine temperature TW is equal to or greater than the first predetermined temperature TWL1 and that the hydraulic oil temperature TO is equal to or greater than the first predetermined temperature TOL1, C1 (stored in a C1 time counter to record the time during which the engine temperature TW is at or above the first predetermined temperature TWL1 and the hydraulic oil temperature TO at or above first predetermined temperature TOL1) is compared with a predetermined time CL1. If C1, stored in the C1 time counter, is equal to or greater than the predetermined time CL1, the overheat prevention operation mode is entered. This overheat prevention operation mode is the mode in which the engine output speed is reduced and/or the position of the swash plate of each of the swash plate type variable displacement hydraulic pumps 10 and 11 is shifted from the predetermined position to reduce the displacement of the hydraulic pumps 10 and 11. This operation mode will be described below. If it is determined that C1 stored in the C1 time counter is less than the predetermined time CL1, C1 is counted up by a predetermined value and the new C1 is stored in the C1 time counter in place of the previous C1. After the contents of the C1 time counter has been changed, the process returns to the start. Operation of the time counter allows a delay time to be set up which prevents the overheat mode from being entered when the temperature lowers to the first predetermined temperature or below after it has instantaneously changed and has remained at or above the first predetermined value for a very short period of time.

If it is determined that the engine temperature TW is equal to or greater than the first predetermined temperature TWL1, that the hydraulic oil temperature TO is greater than or equal to the first predetermined temperature TOL1, and that C1 stored in the C1 time counter is equal to or greater than the predetermined time CL1, ΔT1 is calculated by adding ΔTO stored in the ΔTO memory to a value obtained by multiplying ΔTW stored in the ΔTW memory by a coefficient 'a'. Coefficient 'a' determines which factor is regarded as more important among the engine temperature and the hydraulic oil temperature in the overheat prevention operation, i.e., whether the engine output speed is reduced and/or the position of the swash plate of each of the swash plate type variable displacement hydraulic pumps 10 and 11 is shifted from the predetermined position to reduce the displacement of the hydraulic pumps 10 and 11 in the overheat prevention operation. If coefficient 'a' is greater than 1, the overheat state of the engine temperature is regarded as more important than the overheat state of the hydraulic oil. If coefficient 'a' is less than 1, the overheat state of the hydraulic oil temperature is regarded as more important than the overheat state of the engine temperature.

An amount of shift ΔPS1 of the position of the swash plate and an amount of shift ΔN1 of the position of the governor lever are calculated by substituting the calculated ΔT1 for fp (the function of the amount of shift of the position of the swash plate through which the position of the swash plate of each of the swash plate type variable displacement hydraulic pumps 10 and 11 is shifted from the predetermined position to reduce the displacement of hydraulic pumps 10 and 11) and for fn (the function of the amount of shift of the position of the governor lever through which the position of the governor lever is shifted from the predetermined set position to reduce the engine output speed) respectively. Both the function fp and the function fn may be a linear proportional function or a non-linear function which ensures that the amount of shift ΔPS1 of the position of the swash plate or the amount of shift ΔN1 of the position of the governor lever increases stepwise as ΔT1 increases. Functions fp and fn corresponding to ΔT1, ΔT2 and ΔT3 may be different from each other.

If the calculated ΔT1 is equal to or greater than a predetermined ΔTL1, an instruction PS1, which indicates the position of the swash plate of each of the hydraulic pumps 10 and 11. PS1 represents the position of the swash plate of each of the hydraulic pumps 10 and 11 which has been shifted from the predetermined position PS, by ΔPS1 so that the displacement of the hydraulic pumps 10 and 11 can be reduced. Instruction Nal, which indicates the position of the governor lever, represents the position of the governor lever which has been shifted from the predetermined position by ΔN1, so that the engine output speed can be reduced. If the calculated ΔT1 is less than a predetermined ΔTL1, the instruction PS1 represents the position of the swash plate of each hydraulic pumps 10 and 11 which has been shifted from the predetermined position PS, by ΔPS1 so that the displacement of the hydraulic pumps 10 and 11 can be reduced, while the instruction Na1 which indicates the position of the governor lever remains the same.

Program limiter 1 limits the magnitude of ΔPS1 and ΔN1 in accordance with the power mode and the position of the accelerator dial 17, which instructs the predetermined output speed used when no load is applied, and thereby defines the range in which instruction PS1 and Na1 can be changed.

The position of the swash plate of each of the swash plate type variable displacement hydraulic pumps 10 and 11 and the position of the governor lever are controlled on the basis of the instruction PS1 (indicating the position of the swash plate of each of the swash plate type variable displacement hydraulic pumps 10 and 11) and Na1 (indicating the position of the governor lever) which are determined in the manner described above.

If it is determined that the engine temperature TW is greater than or equal to the first predetermined temperature TWL1, and that the hydraulic oil temperature TO is lower than the first predetermined temperature TOL1, C1 stored in the C1 time counter is cleared, and a value C2 (stored in a C2 time counter to record the time during which the engine temperature TW is greater than or equal to the first predetermined temperature TWL1 and the hydraulic oil temperature TO is less than the first predetermined temperature TOL1) is compared with a predetermined time CL2. If C2 stored in the C2 time counter is greater than or equal to the predetermined time CL2, the overheat prevention operation mode is entered. This overheat prevention operation mode is the mode in which the engine output speed is reduced and/or the position of the swash plate of each of the swash plate type variable displacement hydraulic pumps 10 and 11 is shifted from the predetermined position to reduce the displacement of the hydraulic pumps 10 and 11. This operation mode will be described below.

If it is determined that C2 stored in the C2 time counter is less than the predetermined time CL2, stored C2 is counted by a predetermined value. The new value of C2 is stored in the C2 time counter in place of the old value of C2 which was previously stored in the C2 time counter. After the contents of the C2 time counter has been changed, the process returns to the start.

If it is determined that the engine temperature TW is equal to or greater than the first predetermined temperature TWL1, that the hydraulic oil temperature TO is less than the first predetermined temperature TOL1, and that C2 stored in the C2 time counter is equal to or greater than the predetermined time CL2, ΔT2 is calculated by multiplying ΔTW stored in the ΔTW memory by coefficient 'a'. An amount of shift ΔPS2 of the position of the swash plate and an amount of shift ΔN2 of the position of the governor lever are calculated by substituting the calculated ΔT2 for the aforementioned functions of fp and fn, respectively.

If the calculated ΔT2 is greater than or equal to a predetermined ΔTL2, an instruction PS2 (which indicates the position of the swash plate of each of the swash plate type variable displacement hydraulic pumps 10 and 11) represents the position of the swash plate of each of the hydraulic pumps 10 and 11 which has been shifted from the predetermined position PS by ΔPS2, so that the displacement of the hydraulic pumps 10 and 11 can be reduced. Instruction No. 2 (which indicates the position of the governor lever represents the position of the governor lever which has been shifted from the predetermined position Na by ΔN2, so that the engine output speed can be reduced. If the calculated ΔT2 is less than a predetermined ΔTL2, the instruction PS2, represents the position of the swash plate which has been shifted from the predetermined position PS by ΔPS2, so that the displacement of the hydraulic pumps 10 and 11 can be reduced. Instruction Na2 remains the same.

A program limiter 2 limits the magnitude of ΔPS2 and ΔN2 in accordance with the power mode and the position of the accelerator dial 17. Acceleration dial 17 which instructs the predetermined output speed used when no load is applied and thereby defines the range in which instruction PS2 and Na2 can be changed.

The position of the swash plate of each of the swash plate type variable displacement hydraulic pumps 10 and 11 and the position of the governor lever are controlled on the basis of PS2 plate type variable displacement hydraulic pumps 10 and lever which are determined in the manner described above.

Referring now to FIG. 4, if it is determined that the engine temperature TW is less than the first predetermined temperature TWL1, value C1 stored in the C1 time counter and value C2 stored in the C2 time counter are cleared. If it is determined that the engine temperature TW is less than the first predetermined temperature TWL1 and that the hydraulic oil temperature TO is greater than or equal to the first predetermined temperature TOL1, it is determined that the hydraulic oil temperature is in an overheat alarming state, and a difference ΔTO between the hydraulic oil temperature TO and the first predetermined temperature TOL1 is calculated. The calculated ΔTO is stored in the ΔTO memory. At that time, the calculated ΔTO is present value compared in the ΔTO memory with previous value ΔTO which has been previously calculated and stored in the ΔTO memory.

If it is determined that the previous value ΔTO is less than or equal to the present value ΔTO the previous value ΔTO is replaced by the present value ΔTO, and the present value ΔTO is stored in the ΔTO memory. If it is determined that the previous value ΔTO is greater than or equal to the present value ΔTO, the previous value ΔTO is not replaced by the present value ΔTO in the memory and thus remains in the ΔTO memory without change.

After it has been determined that the engine temperature TW is less than the first predetermined temperature TWL1 and that the hydraulic oil temperature TO is equal to or greater than the first predetermined temperature TOL1, a value C3 stored in a C3 time counter (to record the time during which the engine temperature TW is less than the first predetermined temperature TWL1 and the hydraulic oil temperature TO is the first predetermined temperature TOL1 or above) is compared with a predetermined time CL3. If value C3 stored in the C3 time counter is greater than or equal to the predetermined time CL3, the overheat prevention operation mode is entered.

The overheat prevention operation mode is the mode in which the engine output speed is reduced and/or the position of the swash plate of each of the swash plate type variable displacement hydraulic pumps 10 and 11 is shifted from the predetermined position to reduce the displacement of the hydraulic pumps 10 and 11. This operation mode will be described below.

If it is determined that value C3 stored in the C3 time counter is less than the predetermined time CL3, the value C3 stored is counted up by a predetermined value. This new value C3 is stored in the C3 time counter in place of C3 which has been previously stored in the C3 time counter. After the contents of the C3 time counter has been changed, the process returns to the start.

If it is determined that the engine temperature TW is less than the first predetermined temperature TWL1, that the hydraulic oil temperature TO is equal to or greater than the first predetermined temperature TOL1, and that value C3 stored in the C3 time counter is equal to or greater than the predetermined time CL3, ΔTO stored in the ΔTO memory is assigned to ΔT3. An amount of shift ΔPS3 of the position of the swash plate and an amount of shift ΔN3 of the position of the governor lever are calculated by substituting the calculated ΔT3 for the aforementioned fp and fn, respectively.

If the calculated ΔT3 is equal to or greater than a predetermined ΔTL3, an instruction PS3, (which indicates the position of the swash plate of each of the swash plate type variable displacement hydraulic pumps 10 and 11), represents the position of the swash plate of each of the hydraulic pumps 10 and 11 which has been shifted from the predetermined position PS by ΔPS3, so that the displacement of the hydraulic pumps 10 and 11 can be reduced, and instruction Na3 (which indicates the position of the governor lever) represents the position of the governor lever which has been shifted from the predetermined position Na, by ΔN3 so that the engine output speed can be reduced.

If the calculated ΔT3 is less than a predetermined ΔTL3, PS3 represents the position of the swash plate of each of the hydraulic pumps 10 and 11 which has been shifted from the predetermined position by ΔPS3, so that the displacement of the hydraulic pumps 10 and 11 can be reduced. Instruction remains the same.

A program limiter 3 limits the magnitude of ΔPS3 and ΔN3 in accordance with the power mode and the position of accelerator dial 17 (which instructs the predetermined output speed used when no load is applied) and thereby defines the range in which instruction PS3 and No. 3 can be changed.

The position of the swash plate of each of the swash plate type variable displacement hydraulic pumps 10 and 11 and the position of the governor lever are controlled on the basis of the instruction PS3 and No. 3 which are determined in the manner described above.

If it is determined that the engine temperature TW is less than the first predetermined temperature TWL1 and that the hydraulic oil temperature TO is lower than the first predetermined temperature TOLl, C1, C2 and C3 respectively stored in the C1, C2 and C3 time counters are cleared. It is then determined whether the previous position of the swash plate is one which has been shifted from the instruction PS, indicating the predetermined position of the swash plate of each of the swash plate type variable displacement hydraulic pumps 10 and 11, by ΔPS1, ΔPS2 or ΔPS3 in order to achieve reduction in the displacement of the hydraulic pumps 10 and 11 or whether the previous position of the governor lever is one which has been shifted from the instruction Na, indicating the predetermined set position of the governor lever, by ΔN1, ΔN2 or ΔN3.

If it is determined that the engine temperature TW is less than the first predetermined temperature TWL1, that the hydraulic oil temperature TO is less than the first predetermined temperature TOL1, and that the position of the swash plate has not been shifted so that the displacement of the hydraulic pumps 10 and 11 can be reduced while the position of the governor lever has not been shifted so that the engine output speed can be reduced, the instruction PS1, PS3 or PS3, indicating the previous position of the swash plate of each of the swash plate type variable displacement hydraulic pumps 10 and 11, is replaced by the instruction PS, indicating the predetermined position of the swash plate of each of the swash plate type variable displacement hydraulic pumps 10 and 11, the instruction Na1, Na2 or Na3, indicating the previous position of the governor lever, is replaced by the instruction Na, indicating the predetermined set position of the governor lever, and ΔTW and ΔTO are cleared to zero. Consequently, the swash plate of each of the swash plate type variable displacement hydraulic pumps 10 and 11 is located at a position in accordance with the instruction PS, while the governor lever is located at a position in accordance with the instruction Na, i.e., the overheat prevention operation is not conducted but the normal operation is conducted.

Figure 5:
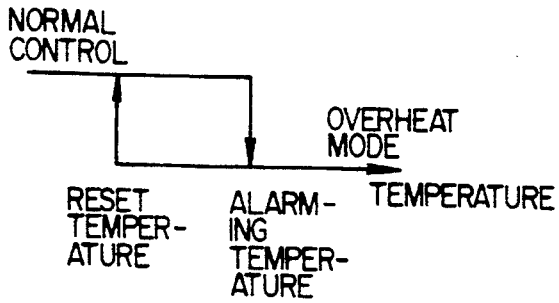
FIG. 5 is a graph showing the relation between the overheat prevention operation initiation determination temperature and the overheat prevention operation suspension determination temperature.

If the engine temperature TW is less than the first predetermined temperature TWL1, the hydraulic oil temperature TO is less than the first predetermined temperature TOL1, and the position of the swash plate has been shifted so that the displacement of the hydraulic pumps 10 and 11 can be reduced or the position of the governor lever has been shifted so that the engine output speed can be reduced, it is determined whether or not the engine temperature TW is lower than a second predetermined temperature TWL2 (see FIG. 5) which is lower than TWL1 and the hydraulic oil temperature TO is lower than a second predetermined temperature TOL2 (see FIG. 5) which is lower than TOL1. If it is determined that the engine temperature TW is lower than the second predetermined temperature TWL2 which is lower than TWL1 and the hydraulic oil temperature TO is lower than the second predetermined temperature TOL2 which is lower than TOL1, the instruction PS1, PS2 or PS3, indicating the previous position of the swash plate of each of the swash plate type variable displacement hydraulic pumps 10 and 11, is replaced by the instruction PS, indicating the predetermined position of the swash plate of each of the swash plate type variable displacement hydraulic pumps 10 and 11, the instruction Na1, Na2 or Na3, indicating the previous position of the governor lever, is replaced by the instruction Na, indicating the predetermined set position of the governor lever, and ΔTW and ΔTO are cleared to zero. Consequently, the swash plate of each of the swash plate type variable displacement hydraulic pumps 10 and 11 is located at a position in accordance with the instruction PS, while the governor lever is located at a position in accordance with the instruction Na, i.e., the overheat prevention operation is not conducted but the operation mode returns to the normal operation to be conducted from the overheat prevention operation. If the engine temperature TW is greater than or equal to the second predetermined temperature TWL2 or the hydraulic oil temperature TO1 is greater than or equal to the second predetermined temperature TOL2, the previous position of the swash plate of each of the swash plate type variable displacement hydraulic pumps 10 and 11 and the previous position of the governor lever are retained, and the overheat prevention operation continues.

Figure 6:
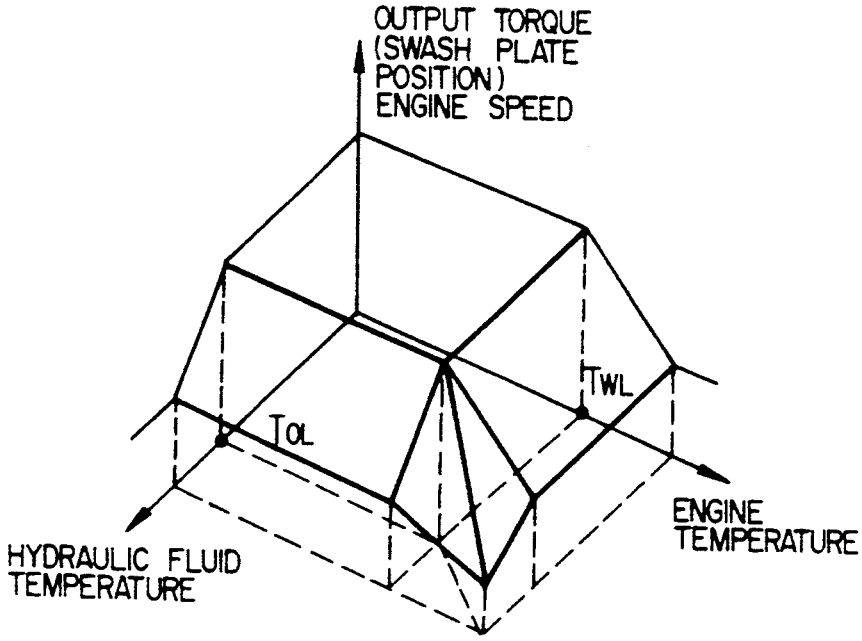
FIG. 6 is a graph showing the relation between changes in the engine output speed and changes in the position of the swash plate which is based on the engine and hydraulic oil temperatures.

ΔTW may also be a difference between TW and a temperature which is lower than TWL1, while ΔTO may also be a difference between TO and a temperature which is lower than TOL1 so that a change in the engine speed or a change in the position of the swash plate can occur immediately after TW exceeds TWL1 or immediately after TO exceeds TOL1. FIG. 6 is a graph showing the relation between changes in the engine output speed and changes in the position of the swash plate which is based on the engine and hydraulic oil temperatures.

What is claimed is:

1. A method for controlling a hydraulic pump driven by an engine, comprising the steps of:

measuring a temperature of at least one of the engine and a hydraulic fluid, comparing the measured temperature with a first predetermined temperature to judge as to whether the measured temperature is higher than the first predetermined temperature or not, calculating a difference between the measured temperature and another predetermined temperature, less than or equal to said first predetermined temperature, decreasing an output flow rate of the hydraulic pump by a degree according to the difference between the measured temperature and said another predetermined temperature, when the measured temperature is judged to be higher than the first predetermined temperature.

2. A method according to claim 1, wherein the first predetermined temperature to be compared with the measured temperature of the engine is different from the first predetermined temperature to be compared with the measured temperature of the hydraulic fluid.

3. A method according to claim 1, wherein said another predetermined temperature compared with the measured temperature of the engine is different from said another predetermined temperature compared with the measured temperature of the hydraulic fluid.

4. A method according to claim 1, wherein an output flow rate per rotation of the hydraulic pump decreased for decreasing the output flow rate of the hydraulic pump.

5. A method according to claim 1, wherein an output rotational speed of the engine driving the hydraulic pump is decreased for decreasing the output flow rate of the hydraulic pump.

6. A method according to claim 1, wherein the first predetermined temperature is substantially equal to the second predetermined temperature.

7. A method according to claim 1, wherein the first predetermined temperature is higher than the second predetermined temperature.

8. A method according to claim 1, wherein the temperature of the engine is a temperature of a the engine.

9. A method according to claim 1, wherein the temperature of the engine is a temperature of a coolant before being cooled by a radiator and after being heated by the engine.

10. A method according to claim 1, wherein the temperature of the engine is a temperature of a coolant after being cooled by a radiator and before being heated by the engine.

11. A method according to claim 1, wherein the temperature of the engine is a temperature of a pipe through which a coolant of the engine flows.

12. A method according to claim 1, wherein the output flow rate of the hydraulic pump is increased when the measured temperature is lower than a second predetermined temperature less than the first predetermined temperature after decreasing the output flow rate of the hydraulic pump.

13. A method according to claim 1, wherein the output flow rate of the hydraulic pump is prevented from being increased when the measured temperature is not lower than a second predetermined temperature less than the first predetermined temperature, after decreasing the output flow rate of the hydraulic pump.

14. A method according to claim 1, wherein the output flow rate of the hydraulic pump is increased when the measured temperature is lower than a second predetermined temperature after decreasing the output flow rate of the hydraulic pump, and the second predetermined temperature is less than the first predetermined temperature and less than said another predetermined temperature.

15. A method according to claim 1, wherein the output flow rate of the hydraulic pump is increased when the measured temperature is lower than a second predetermined temperature after decreasing the output flow rate of the hydraulic pump, and the second predetermined temperature is less than the first predetermined temperature and more than said another predetermined temperature.

16. A method according to claim 1, wherein the output flow rate of the hydraulic pump is decreased by the degree according to the difference between the measured temperature and said another predetermined temperature, when the measured temperature is kept higher than the first predetermined temperature during a time more than predetermined time.

17. A method according to claim 1, wherein both of the output flow rate per rotation of the hydraulic pump and the output rotational speed of the engine driving the hydraulic pump are decreased for decreasing the output flow rate of the hydraulic pump, when the measured temperature is higher than the first predetermined temperature and the difference between the measured temperature and said another predetermined temperature is more than a predetermined degree.

18. A method according to claim 1, wherein the output flow rate of the hydraulic pump is decreased by a degree according to a total amount of the difference between the measured temperature of the engine and said another predetermined temperature and the difference between the measured temperature of the hydraulic fluid and said another predetermined temperature, when the measured temperature is judged to be higher than the first predetermined temperature.

19. A method according to claim 1, wherein the output flow rate of the hydraulic pump is decreased by the degree according to the difference between the maximum temperature measured after a start of decreasing the output flow rate of the hydraulic pump and said another predetermined temperature.

20. A method according to claim 1, wherein the output flow rate of the hydraulic pump is decreased by the degree according to the difference between the maximum temperature measured after a start of decreasing the output flow rate of the hydraulic pump and said another predetermined temperature, when the measured temperature is not higher than the first predetermined temperature and is not lower than a second predetermined temperature less than the first predetermined temperature, after decreasing the output flow rate of the hydraulic pump.

* * * * *